US008711082B2

(12) United States Patent
Cheng et al.

(10) Patent No.: US 8,711,082 B2
(45) Date of Patent: Apr. 29, 2014

(54) METHOD FOR DRIVING BISTABLE DISPLAY DEVICE

(75) Inventors: Ying-Chuan Cheng, Hsinchu (TW); Rui-Yang Lai, Hsinchu (TW)

(73) Assignee: E Ink Holdings Inc., Hsinchu County (TW)

( * ) Notice: Subject to any disclaimer, the term of this patent is extended or adjusted under 35 U.S.C. 154(b) by 441 days.

(21) Appl. No.: 12/778,200

(22) Filed: May 12, 2010

(65) Prior Publication Data

US 2010/0289790 A1 Nov. 18, 2010

(30) Foreign Application Priority Data

May 13, 2009 (TW) ..... 98115911 A

(51) Int. Cl.
*G09G 5/00* (2006.01)
*G09G 3/36* (2006.01)
*G09G 3/34* (2006.01)

(52) U.S. Cl.
USPC ..... 345/102; 345/84; 345/211; 382/232

(58) Field of Classification Search
USPC ..... 345/49, 95, 96, 105, 106, 107, 210, 84, 345/99, 108, 102, 211; 430/31, 32, 33, 34, 430/35, 36; 359/296; 382/232
See application file for complete search history.

(56) References Cited

U.S. PATENT DOCUMENTS

| | | | | |
|---|---|---|---|---|
| 7,119,772 | B2 * | 10/2006 | Amundson et al. | 345/87 |
| 2007/0126673 | A1 * | 6/2007 | Djordjev et al. | 345/84 |
| 2007/0147688 | A1 * | 6/2007 | Mathew | 382/232 |
| 2008/0284719 | A1 * | 11/2008 | Yoshida | 345/102 |

FOREIGN PATENT DOCUMENTS

| | | | |
|---|---|---|---|
| CN | 101120393 | A | 2/2008 |
| CN | 101192386 | A | 6/2008 |
| TW | 200504667 | A | 2/2005 |
| TW | 200807352 | A | 2/2008 |
| TW | 200842443 | A | 11/2008 |
| TW | 200915258 | A | 4/2009 |

OTHER PUBLICATIONS

China Official Action issued Jul. 4, 2012.
Taiwan Official Action issued on Mar. 11, 2013.

* cited by examiner

*Primary Examiner* — Quan-Zhen Wang
*Assistant Examiner* — Michael J Eurice
(74) *Attorney, Agent, or Firm* — Chun-Ming Shih

(57) ABSTRACT

A method for driving a bistable display device is provided. The bistable display device has a matrix of pixels arranged in a plurality of rows and a plurality of columns, a timing controller and a source driver. The timing controller is configured to sequentially output control signals which correspond to a positive high voltage, a negative high voltage and a ground voltage respectively to the source driver. The source driver is configured to drive each pixel with the voltages corresponding to the control signals. The method comprises: providing only the positive high voltage or the ground voltage to one of two pixels in two adjacent rows of the same column if the source driver provides the positive high voltage to the other one when the source driver consecutively drives the two pixels.

8 Claims, 2 Drawing Sheets

| voltage table | G0→G0 | G0→G1 | G0→G2 | G0→G3 | G0→G4 | G0→G5 | G0→G6 | ... | G15→G14 | G15→G15 |
|---|---|---|---|---|---|---|---|---|---|---|
| Frame 0 | VPOS | VPOS | GND | VPOS | VNEG | ... | ... | ... | ... | ... |
| Frame 1 | VPOS | ... | ... | ... | ... | ... | ... | ... | ... | ... |
| Frame 2 | GND | ... | ... | ... | ... | ... | ... | ... | ... | ... |
| Frame 3 | VNEG | ... | ... | ... | ... | ... | ... | ... | ... | ... |
| Frame 4 | VPOS | ... | ... | ... | ... | ... | ... | ... | ... | ... |
| Frame 5 | VPOS | ... | ... | ... | ... | ... | ... | ... | ... | ... |
| Frame 6 | GND | ... | ... | ... | ... | ... | ... | ... | ... | ... |
| Frame 7 | ... | ... | ... | ... | ... | ... | ... | ... | ... | ... |
| Frame 8 | ... | ... | ... | ... | ... | ... | ... | ... | ... | ... |
| Frame 9 | ... | ... | ... | ... | ... | ... | ... | ... | ... | ... |
| ⋮ | ... | ... | ... | ... | ... | ... | ... | ... | ... | ... |
| Frame 58 | ... | ... | ... | ... | ... | ... | ... | ... | ... | ... |
| Frame 59 | ... | ... | ... | ... | ... | ... | ... | ... | ... | ... |
| Frame 60 | ... | ... | ... | ... | ... | ... | ... | ... | ... | ... |

FIG. 2

METHOD FOR DRIVING BISTABLE DISPLAY DEVICE

CROSS-REFERENCE TO RELATED APPLICATIONS

This application is based upon and claims the benefit of priority from the prior Taiwan Patent Application No. 098115911, filed May 13, 2009, the entire contents of which are incorporated herein by reference.

BACKGROUND

Currently, the applications of the flat panel display device become more and more widespread, and this brings more convenience to our lives. Since the electronic paper display device is convenient to carry and has the advantage of low power consumption, the electronic paper display device is regarded as a flat panel display technology of next generation.

The electronic paper display device has two substrates, and the place between the two substrates is poured with black particles which are positively charged, white particles which are negatively charged and solvent. One of the two substrates is transparent. The areas supplied with positive voltage of the transparent substrate will attract the white particles to display white color; the areas supplied with negative voltage of the transparent substrate will attract the black particles to display black color. The other substrate has a plurality of common electrode supplied with a reference voltage. Since the specific gravities of the solvent and the charged particles are about the same, the electronic paper display device has the bistable characteristic. Therefore, even though the electric field disappears, the charged particles will be remained at the same position for a lone time till a next electric field enables the charged particles to move to form another display image. In addition, since it is unnecessary to continue the charge after updating a display image, the power consumption is low.

Generally speaking, the electronic paper display device has a matrix of pixels arranged in a plurality of rows and a plurality of columns, a timing controller and a source driver. The timing controller is configured to sequentially output control signals which correspond to a positive high voltage, a negative high voltage and a ground voltage respectively to the source driver, and the source driver is configured to drive each pixel with the voltages corresponding to the control signals. After a predetermined time length, the effects of supplying voltages to the pixels will be accumulated, so that an updated display image is formed.

In the conventional method for driving a bistable display device, the timing controller controls the source driver to provide voltages to drive each pixel according to received data when a display image of the bistable display device is updated, and the data formats of the control signals transmitted to the source driver do not have any limitation. As to the pixels in different rows of the same column, the driving sequence of the pixels may be generally defined as the arrangement sequence of the pixels. For example, the pixels may be scanned form top to bottom by way of row scanning. At a certain time, a certain pixel may be driven by the positive high voltage, the negative high voltage or the ground voltage. However, if the source driver provides the positive high voltage to one of two pixels in two adjacent rows of the same column and provides the negative high voltage to the other one when the source driver consecutively drives the two pixels during the image updating process, it can be seen after the testing that the source driver will consume a large power because the source driver switches the output voltage by a wide margin. This will result in the display anomalies such as crosstalk and band mura, and the image display quality of the bistable display device will be reduced.

BRIEF SUMMARY

The present invention relates to a method for driving a bistable display device, and the method can enhance the image display quality of the bistable display device.

The present invention provides a method for driving a bistable display device. The bistable display device has a matrix of pixels arranged in a plurality of rows and a plurality of columns, a timing controller and a source driver. The timing controller is configured to sequentially output control signals which correspond to a positive high voltage, a negative high voltage and a ground voltage respectively to the source driver. The source driver is configured to drive each pixel with the voltages corresponding to the control signals. The method comprises: providing the positive high voltage or the ground voltage to one of two pixels in two adjacent rows of the same column if the source driver provides the positive high voltage to the other one when the source driver consecutively drives the two pixels.

In a preferred embodiment of the present invention, the method further comprising the step of looking for the timings of driving voltages used for updating the gray-scales of the pixels from a predetermined lookup table before the timing controller outputs the control signals to the source driver, so that the timing controller can output corresponding control signals to the source driver according to the timings of the driving voltages.

In the preferred embodiments of the present invention, the content arrangement of the predetermined voltage table used for defining the relations between the variations of the gray-scale updating and the timings of the driving voltage is limited, so that the source driver will provide the positive high voltage or the ground voltage to one of two pixels in two adjacent rows of the same column if the source driver provides the positive high voltage to the other one when the source driver consecutively drives the two pixels, and the source driver will provide the negative high voltage or the ground voltage to one of the two pixels if the source driver provides the negative high voltage to the other one. Thus, the source driver will not directly switch the output voltage from the positive high voltage to the negative high voltage or form the negative high voltage to the positive high voltage, so as to prevent from high power consumption. Furthermore, the display anomalies resulted from the voltage switching such as crosstalk and band mura are also solved, and the image display quality of the bistable display device can be enhanced.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 2 illustrates the contents of the voltage table employ by the timing controller of the bistable display device shown in FIG. 1.

DETAILED DESCRIPTION

Figure 1:
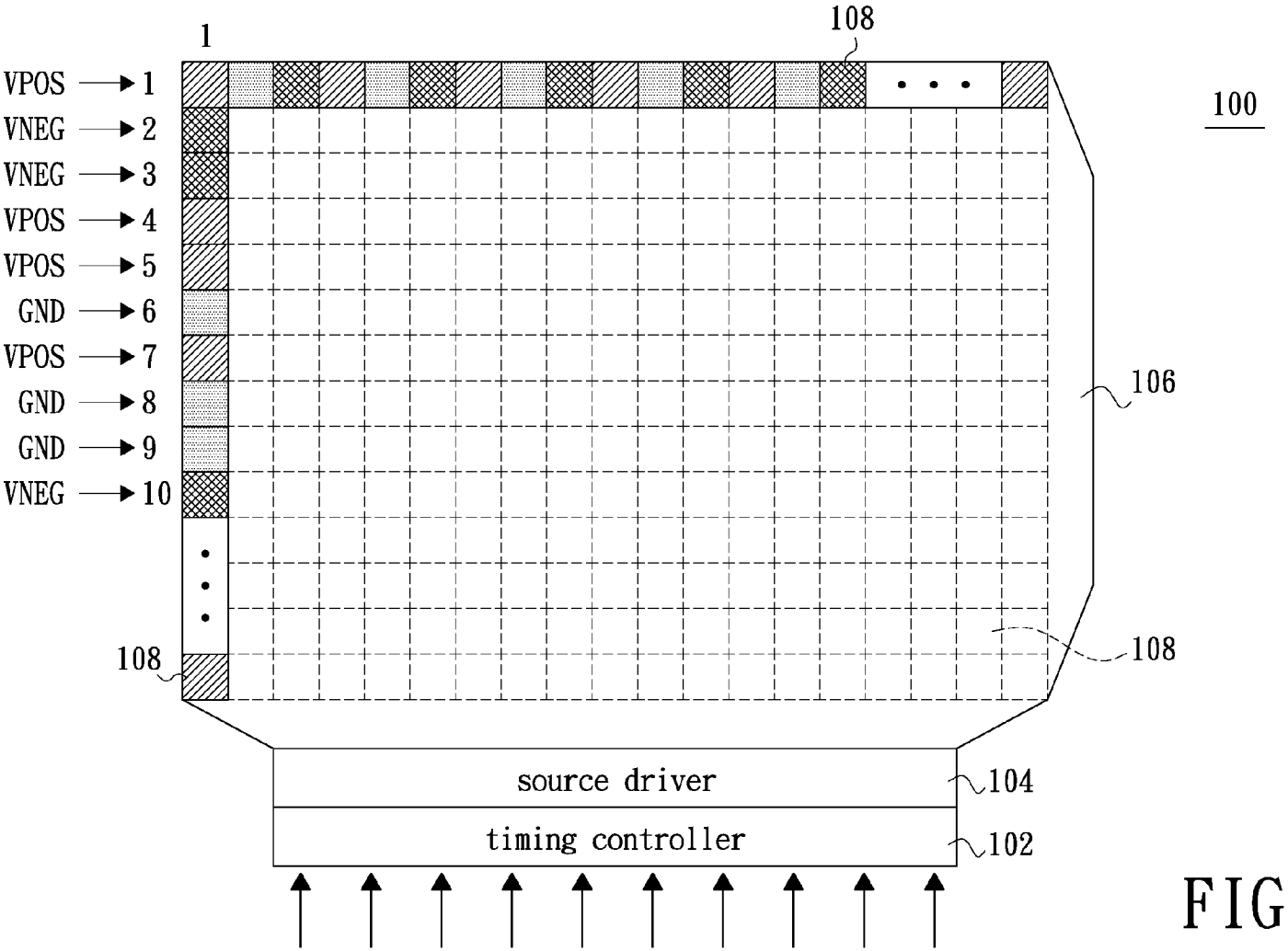
FIG. 1 illustrates a method for driving a bistable display device according to a preferred embodiment of the present invention.

Referring to FIG. 1, a method for driving a bistable display device according to a preferred embodiment of the present invention is illustrated. The method is adopted for driving a bistable display device 100. The bistable display device 100 comprises a timing controller 102, a source driver 104 and a display panel 106. The display panel 106 has a matrix of pixels 108 arranged in a plurality of rows and a plurality of columns. The timing controller 102 is configured to sequentially output control signals corresponding to a positive high voltage VPOS, a negative high voltage VNEG and a ground voltage GND respectively to the source driver 104. The source driver 104 is configured to drive each pixel 108 according to voltages corresponding to the control signals.

The control signals may be digital signals. For example, the signal 01 represents the positive high voltage VPOS, the signal 10 represents the negative high voltage VNEG, and the signal 00 represents the ground voltage GND. In this embodiment, the pixels 108 will be scanned by way of row scanning when the bistable display device 100 updates a display image. That is, the pixels 108 of the same row will be driven simultaneously, and the pixels 108 of different rows will be driven sequentially. When a certain pixel 108 of a certain row is scanned, the certain pixel 108 will be driven by the positive high voltage VPOS for a predetermined time length (i.e., the time length of a frame) if the source driver 104 receives a control signal 01; when a certain pixel 108 of a certain row is scanned, the certain pixel 108 will be driven by the negative high voltage VNEG for the time length of a frame if the source driver 104 receives a control signal 10; when a certain pixel 108 of a certain row is scanned, the certain pixel 108 will be driven by the ground voltage GND for the time length of a frame if the source driver 104 receives a control signal 00. After a plurality of frame scans, the effects of supplying driving voltages to the pixel 108 will be accumulated, so that the updating of the pixel 108 will be accomplished. Similarly, when all of the pixels 108 have been updated in accordance with the aforementioned manner, the updating of the whole display image is accomplished. Generally speaking, the number of frames needed to scan for updating a display image and the time length of each frame are predetermined at the time that the system is being designed.

When the bistable display device 100 updates a display image, the display gray-scale of each pixel 108 may change from a gray-scale value to another gray-scale value or keep at the original gray-scale value. In this embodiment, the timing controller 102 needs to look for the timings of driving voltages used for updating the gray-scales of the pixels 108 from a lookup table in the aforementioned two situations. That is, the timing controller 102 needs to look for the driving voltages used for updating the gray-scales of the pixels 108 in different frames. The lookup table is also called the voltage table. In this embodiment, the content of the voltage table is illustrated in FIG. 2. The horizontal direction of the voltage table shown in FIG. 2 illustrates a variety of possibilities of updating the gray-scales. Wherein, G0, G1, G2 . . . G15 respectively represent a variety of gray-scales. G0->G1 represents the gray-scale of a certain pixel 108 is G0 before updating the certain pixel 108 and the gray-scale of the certain pixel 108 is G1 after updating the certain pixel 108. G0->G0 represents the gray-scale of a certain pixel 108 is G0, whether the certain pixel 108 is updated or not. The vertical direction of the voltage table shown in FIG. 2 represents the predetermined sequences of the frames. In this embodiment, frame 0, frame 1, frame 2 . . . frame 60 are arranged sequentially. The contents of the voltage table illustrate the information of the driving voltages corresponding to a variety of possibilities to update the gray-scales of the pixels 108 in different frames. After acquiring the driving voltages used for driving the pixels 108 in different frames from the voltage table, the timing controller 102 outputs corresponding control signals to the source driver 104 immediately, so that the source driver 104 may drive the pixels 108 by the driving voltages according to the predetermined sequence in different frames.

In this embodiment, in order to avoid the source driver 104 to directly switches the output voltage from the positive high voltage VPOS to the negative high voltage VNEG or form the negative high voltage VNEG to the positive high voltage VPOS, the source driver 104 will only provide the positive high voltage VPOS or the ground voltage GND to one of two pixels 108 in two adjacent rows of the same column if the source driver 104 provides the positive high voltage VPOS to the other one when the source driver 104 consecutively drives the two pixels 108. The source driver 104 will only provide the negative high voltage VNEG or the ground voltage GND to one of the two pixels 108 if the source driver 104 provides the negative high voltage VNEG to the other one. As to the pixels of the first column shown in FIG. 1, the pixels of the first row and the second row are driven by the positive high voltage VPOS and the negative high voltage VNEG respectively, and the pixels of the third row and the fourth row are driven by the negative high voltage VNEG and the positive high voltage VPOS respectively. The two aforementioned situations are violation situations and should be interdicted.

In this embodiment, the aforementioned limitation may be specifically implemented by limiting the data format of the voltage table. For example, the aforementioned limitation may be specifically implemented by interdicting two certain grids on the horizontal direction and two adjacent grids on the vertical direction of the voltage table to show the information representing the positive high voltage VPOS and the negative high voltage VNEG respectively. On the vertical direction of the voltage table (i.e., the changes of different frames) shown in FIG. 2, the driving voltages corresponding to frame 3 and frame 4 in the situation of updating the gray-scale from level G0 to level G0 are the positive high voltage VPOS and the negative high voltage VNEG respectively, and this (as shown by the shadow in FIG. 2) should be interdicted. Furthermore, on the horizontal direction of the voltage table (i.e., a variety of changes of gray-scale at the same frame), the driving voltages in the situations of updating the gray-scale from level G0 to level G0 and from level G0 to level G2 are the positive high voltage VPOS and the driving voltage in the situation of updating the gray-scale from level G0 to level G4 is the negative high voltage VNEG, and this should also be interdicted.

It can be understood that the specific arrangement form of the contents of the voltage table may be changed in accordance with the needs of different designs. For example, the contents on the horizontal direction and the contents on the vertical direction of the voltage table may be exchanged. No matter which form is adopted by the voltage table, the timing arrangement of the driving voltages in a variety of the situations of gray-scale updating may be pre-adjusted correspondingly, so as to avoid the aforementioned violation situations.

In this embodiment, the bistable display device 100 may be an electrophoretic display device such as an electronic ink display. It can be understood that the bistable display device 100 may also be a display device of other types such as a cholesteric liquid crystal display device.

In the preferred embodiments mentioned above, the content arrangement of the predetermined voltage table used for defining the relations between the variations of the gray-scale updating and the timings of the driving voltage is limited, so that the source driver will provide the positive high voltage or the ground voltage to one of two pixels in two adjacent rows of the same column if the source driver provides the positive high voltage to the other one when the source driver consecutively drives the two pixels, and the source driver will provide the negative high voltage or the ground voltage to one of the two pixels if the source driver provides the negative high voltage to the other one. Thus, the source driver will not directly switch the output voltage from the positive high voltage to the negative high voltage or form the negative high voltage to the positive high voltage, so as to prevent from high power consumption. Furthermore, the display anomalies resulted from the voltage switching such as crosstalk and band mura are also solved, and the image display quality of the bistable display device can be enhanced.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method for driving a bistable display device, comprising:

providing the bistable display device having a matrix of pixels arranged in a plurality of rows and a plurality of columns, a timing controller and a source driver, the timing controller being configured to sequentially output control signals which correspond to a positive high voltage, a negative high voltage and a ground voltage respectively to the source driver, the source driver being configured to drive each pixel with the voltages corresponding to the control signals;

providing the positive high voltage, the negative high voltage or the ground voltage to each of two pixels in any two adjacent rows of the same column in an image frame;

interdicting the negative high voltage to be provided to one of the two pixels in the image frame if the source driver provides the positive high voltage to the other one of the two pixels in the image frame when the source driver consecutively drives the two pixels in the image frame; and interdicting the positive high voltage to be provided to one of the two pixels in the image frame if the source driver provides the negative high voltage to the other one of the two pixels in the image frame when the source driver consecutively drives the two pixels in the image frame.

2. The method as claimed in claim 1, wherein the bistable display device is a cholesteric liquid crystal display device.

3. The method as claimed in claim 1, wherein the bistable display device is an electrophoretic display device.

4. The method as claimed in claim 1, wherein the bistable display device is an electronic ink display.

5. The method as claimed in claim 1, further comprising:

looking for the timings of driving voltages used for updating the gray-scales of the pixels from a predetermined lookup table before the timing controller outputs the control signals to the source driver, so that the timing controller can output corresponding control signals to the source driver according to the timings of the driving voltages.

6. The method as claimed in claim 5, wherein a first direction of the lookup table represents a variety of possibilities to update the gray-scales of the pixels, a second direction of the lookup table represents a predetermined sequence of time periods, the contents of the lookup table represent the messages of driving voltages used for driving the pixels in the situations of different time periods and different possibilities to update the gray-scales, and the method further comprises:

interdicting the messages respectively represent the positive high voltage and the negative high voltage to appear in two adjacent grids on the second direction of the lookup table.

7. The method as claimed in claim 5, wherein the bistable display device is a cholesteric liquid crystal display device.

8. The method as claimed in claim 5, wherein the bistable display device is an electrophoretic display device.

* * * * *